US007137824B2

(12) United States Patent
Lin

(10) Patent No.: US 7,137,824 B2
(45) Date of Patent: Nov. 21, 2006

(54) CONNECTING UNIT FOR A BACKLIGHT MODULE

(75) Inventor: Tang-Pung Lin, Tainan (TW)

(73) Assignee: Chi Lin Technology Co., Ltd., Tainan County (TW)

( * ) Notice: Subject to any disclaimer, the term of this patent is extended or adjusted under 35 U.S.C. 154(b) by 0 days.

(21) Appl. No.: 11/412,930

(22) Filed: Apr. 28, 2006

(65) Prior Publication Data

US 2006/0194463 A1 Aug. 31, 2006

Related U.S. Application Data

(63) Continuation-in-part of application No. 10/943,883, filed on Sep. 20, 2004, now abandoned.

(51) Int. Cl.
*H01R 12/00* (2006.01)

(52) U.S. Cl. ..... 439/58; 439/881

(58) Field of Classification Search ..... 439/58, 439/226, 242, 375, 699.2, 881
See application file for complete search history.

(56) References Cited

U.S. PATENT DOCUMENTS

| | | | | |
|---|---|---|---|---|
| 4,181,390 | A | 1/1980 | Aizawa | |
| 4,804,343 | A * | 2/1989 | Reedy | 439/854 |
| 5,008,588 | A | 4/1991 | Nakahara | |
| 5,501,618 | A * | 3/1996 | Muta et al. | 439/699.2 |
| 5,597,329 | A | 1/1997 | Takano et al. | |
| 5,610,472 | A | 3/1997 | Schmitt | |
| 6,254,252 | B1 * | 7/2001 | Coushaine et al. | 362/549 |
| 6,332,796 | B1 | 12/2001 | Chen | |
| 6,372,993 | B1 * | 4/2002 | Eckels et al. | 174/152 GM |
| 6,799,987 | B1 | 10/2004 | Park | |

* cited by examiner

*Primary Examiner*—Thanh-Tam Le
(74) *Attorney, Agent, or Firm*—Berenato, White & Stavish

(57) ABSTRACT

A connecting unit includes a support seat that has inner and outer surfaces, that is formed with an L-shaped channel, and that is provided with a slit. The L-shaped channel is defined by the inner surface, has first and second open ends, receives an end portion of an electrical wire therein through the first open end, and receives an end portion of a fluorescent tube therein through the second open end. The slit extends from the outer surface to the inner surface and from the first open end to the second open end to thereby permit access into the L-shaped channel.

6 Claims, 3 Drawing Sheets

CONNECTING UNIT FOR A BACKLIGHT MODULE

CROSS-REFERENCE TO RELATED APPLICATION

This application is a continuation-in-part (CIP) of U.S. patent application Ser. No. 10/943,883 filed Sep. 20, 2004, and abandoned as of the filing date of this application.

BACKGROUND OF THE INVENTION

1. Field of the Invention

The invention relates to a connecting unit, more particularly to a connecting unit for a backlight module.

2. Description of the Related Art

FIG. 1 illustrates a conventional non-conductive support seat 12 of a backlight module (not shown) that includes an electrical wire 11 and a fluorescent tube 13. The support seat 12 defines a channel 120. The electrical wire 11 has an end portion that is stripped to expose conductors ill thereof and that is extended into the channel 120. The fluorescent tube 13 has an end portion that is extended into the channel 120, and a pin 131 that extends from the end portion thereof and that is soldered to the exposed conductors 111 of the electrical wire 11. During assembly, the electrical wire 11 has to be bent by ninety degrees. As a consequence, the bent portion of the electrical wire 11 occupies a relatively large space in the backlight module.

SUMMARY OF THE INVENTION

Therefore, the object of the present invention is to provide a support seat that eliminates the need for bending of an electrical wire when assembling a backlight module.

According to the present invention, a connecting unit comprises a non-conductive elastic support seat The connecting unit is applicable to a backlight module that includes an electrical wire and a fluorescent tube The non-conductive elastic support seat has inner and outer surfaces, is formed with an L-shaped channel, and is provided with a slit. The L-shaped channel is defined by the inner surface, has first and second open ends, is adapted to receive an end portion of the electrical wire therein through the first open end, and is adapted to receive an end portion of the fluorescent tube therein through the second open end. The slit extends from the outer surface to the inner surface and from the first open end to the second open end to thereby permit access into the L-shaped channel.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
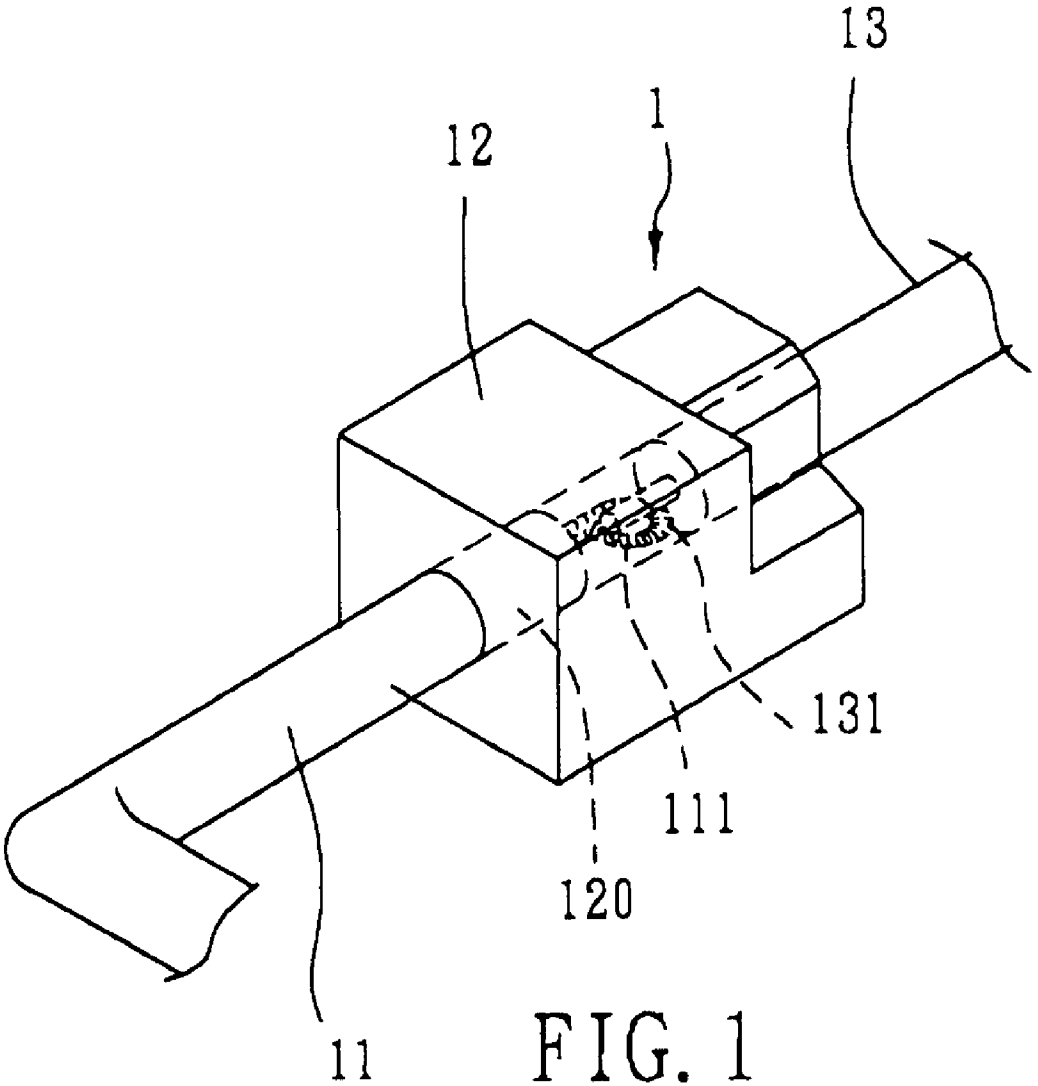
FIG. 1 PRIOR ART
FIG. 1 illustrates a conventional non-conductive support seat of a backlight module.
Figure 2:
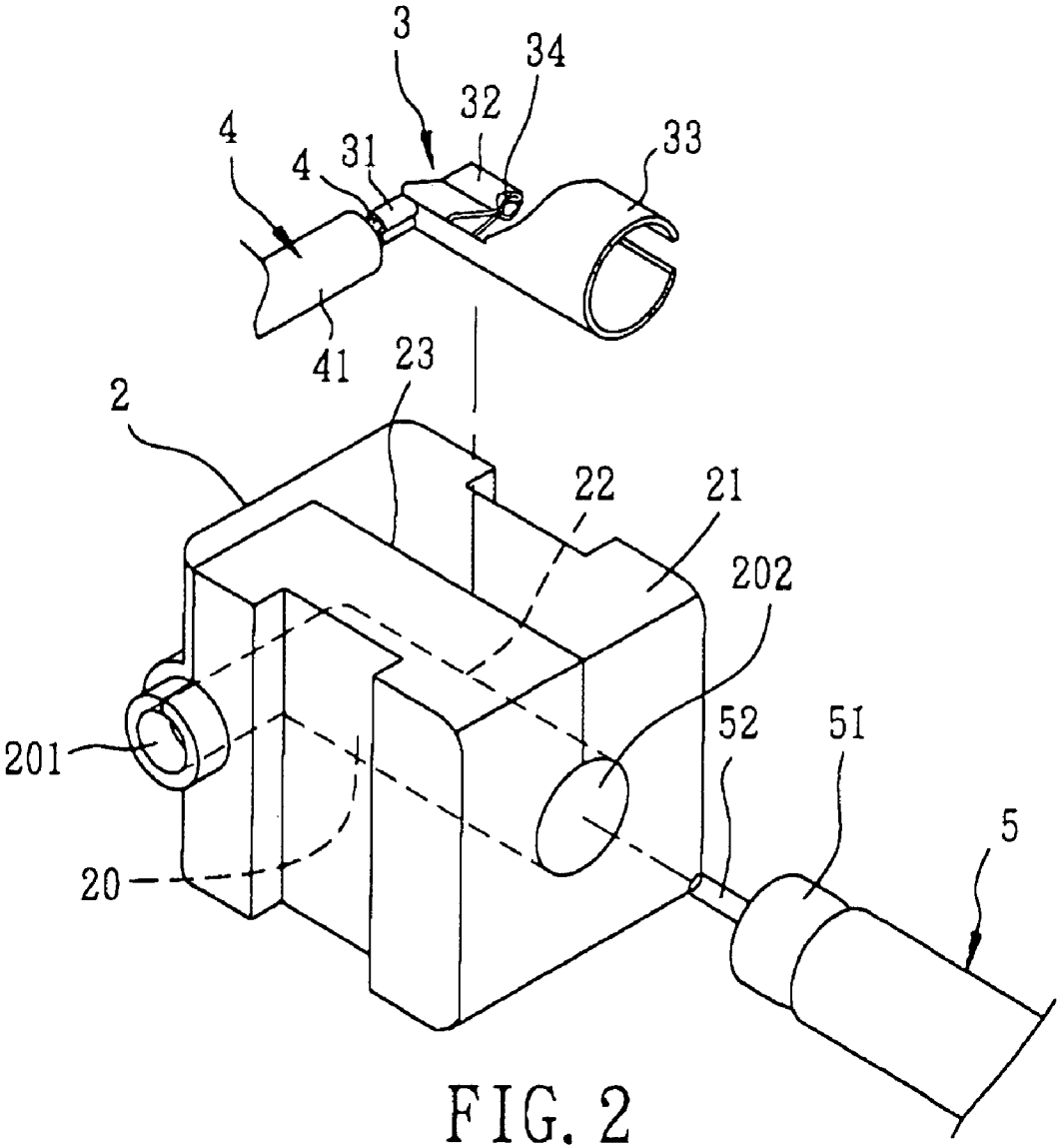
FIG. 2 is a perspective view of the preferred embodiment of a connecting unit of a backlight module according to the present invention.

Referring to FIG. 2, the preferred embodiment of a connecting unit according to this invention is shown to include a non-conductive elastic support seat 2 and a conductive connector 3.

The connecting unit is applicable to a backlight module (not shown) that includes an electrical wire 4 and a fluorescent tube 5. The electrical wire 4 of the backlight module has an end portion 41 that is stripped to expose a conductor 42 thereof The fluorescent tube has an end portion 51, and a pin 52 that extends from the end portion 51 thereof.

The non-conductive elastic support seat 2 has inner and outer surfaces 21, 22, is formed with an L-shaped channel 20, and is provided with a slit 23. In this embodiment, the non-conductive elastic support seat 2 is made from a rubber or a plastic.

The L-shaped channel 20 is defined by the inner surface 22, has first and second open ends 201, 202, receives the end portion 41 of the electrical wire 4 therein through the first open end 201, and receives the end portion 51 of the fluorescent tube 5 therein through the second open end 202.

The slit 23 extends from the outer surface 21 to the inner surface 22 and from the first open end 201 to the second open end 202 for permitting access into the L-shaped channel 20.

The conductive connector 3, which is preferably made from gold, is disposed in the L-shaped channel 20 in the non-conductive elastic support seat 3, and connects electrically the exposed conductor 42 of the electrical wire 4 and the pin 52 of the fluorescent tube 5. In particular, the conductive connector 3 includes first, second, and third clamping parts 31, 32, 33

The first clamping part 31 of the conductive connector 3 is inverted U-shaped, and includes a pair of crimping arms that clamp securely the exposed conductor 42 of the electrical wire 4.

The second clamping part 32 of the conductive connector 3 extends between the first and third clamping parts 31, 33, and includes a pair of clamping arms that converge toward each other and that clamp releasably the pin 52 of the fluorescent tube 5 therebetween. The second clamping part 32 of the conductive connector 3 further includes a pair of guide flanges 34 that are formed respectively on the clamping arms of the second clamping part 32. The guide flanges 34 confine a converging entrance that serves to guide insertion of the pin 52 of the fluorescent tube 5 between the clamping arms of the second clamping part 32.

The third clamping part 33 of the conductive connector 3 is C-shaped, and clamps the end portion 51 of the fluorescent tube 5.

Figure 3:
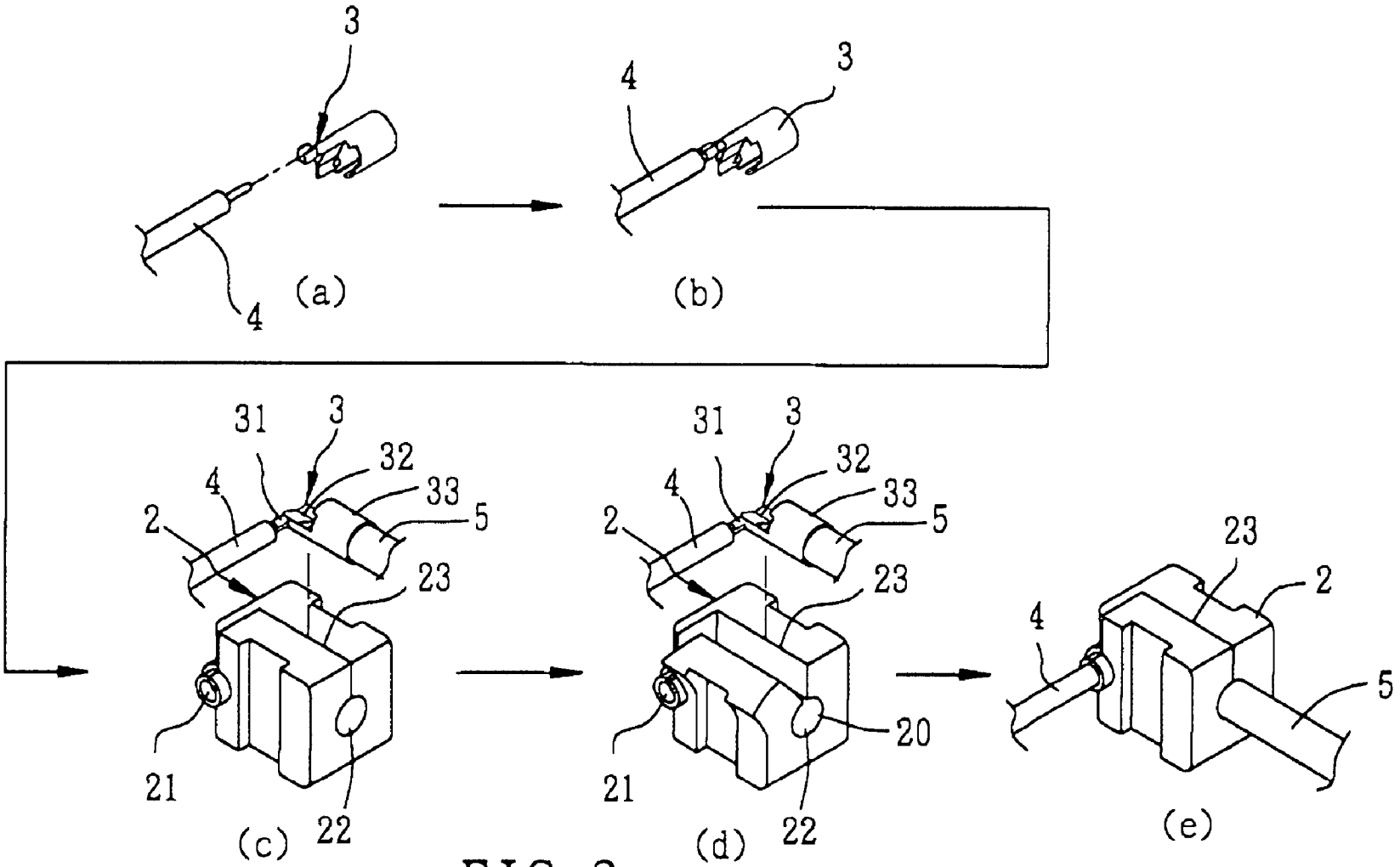
FIG. 3 illustrates a method of assembling the preferred embodiment.

Referring to FIG. 3, a method for assembling the connecting unit includes the steps of:

(a) stripping the end portion 41 of the electrical wire 4 to expose the conductor 42;

(b) crimping the exposed conductor 42 of the electrical wire 4 between the crimping arms of the first clamping part 31 of the conductive connector 3 with the use of a crimping tool (not shown);

(c) bringing the fluorescent tube 5 toward the conductive connector 3 and manipulating the fluorescent tube 5 such that the pin 52 (see FIG. 2) of the fluorescent tube 5 is inserted between the clamping arms of the second clamping part 32 through the guide flanges 34 and such that the end portion 51 (see FIG. 2) of the fluorescent tube 5 is press-fitted into the third clamping part 33;

(d) stretching the slit 23 to open the same; and (e) disposing the conductive connector 3 in the L-shaped channel 20 through the opened slit 23.

In an alternative embodiment, the connecting unit is dispensed with the conductive connector 3. The exposed conductor 42 of the electrical wire 4 and the pin 52 of the fluorescent tube 5 are connected electrically by soldering.

It has thus been shown that the connecting unit of this invention includes a non-conductive elastic support seat 2 that is formed with an L-shaped channel 20, and that is provided with a slit 23 to permit access into the L-shaped channel 20. As such, the electrical wire 4 is not required to be bent when assembling the backlight module. Hence, the aforesaid drawback associated with the prior art can be eliminated.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A connecting unit for a backlight module, the backlight module including an electrical wire having an end portion, and a fluorescent tube having an end portion, said connecting unit comprising:

a non-conductive elastic support seat having inner and outer surfaces, formed with an L-shaped channel that is defined by said inner surface, that has first and second open ends, that is adapted to receive the end portion of the electrical wire therein through said first open end, and that is adapted to receive the end portion of the fluorescent tube therein through said second open end, and provided with a slit that extends from said outer surface to said inner surface and from said first open end to said second open end to thereby permit access into said L-shaped channel.

2. The connecting unit as claimed in claim 1, further comprising a conductive connector disposed in said L-shaped channel in said non-conductive elastic support seat, said conductive connector including a first clamping part that is adapted to clamp an exposed conductor of the electrical wire, and a second clamping part that extends from said first clamping part, and that is adapted to clamp a pin of the fluorescent tube.

3. The connecting unit as claimed in claim 2, wherein said second clamping part includes a pair of clamping arms that are adapted to clamp the pin of the fluorescent tube therebetween.

4. The connecting unit as claimed in claim 3, wherein said second clamping part further includes a pair of guide flanges formed respectively on said clamping arms of said second clamping part, said guide flanges confining a converging entrance for guiding insertion of the pin of the fluorescent tube between said clamping arms of said second clamping part.

5. The connecting unit as claimed in claim 2, further comprising a third clamping part adapted to clamp the end portion of the fluorescent tube, said second clamping part extending between said first and third clamping parts.

6. The connector as claimed in claim 5, wherein said third clamping part is C-shaped.

* * * * *